United States Patent [19]

Schiffer

[11] 4,043,157

[45] Aug. 23, 1977

[54] SEALING ARRANGEMENT FOR PRESSURE CONTAINERS, ESPECIALLY FOR THE TREATMENT OF WEBS OF TEXTILE GOODS

[75] Inventor: Günter Schiffer, Krefeld, Germany

[73] Assignee: Kleinewefers Industrie-Companie GmbH, Krefeld, Germany

[21] Appl. No.: 630,134

[22] Filed: Nov. 10, 1975

[30] Foreign Application Priority Data

Nov. 8, 1974 Germany ..... 2453059

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 2,986,912 | 6/1961 | Richeson et al. | 68/5 E |
| 3,352,129 | 11/1967 | Johnson | 68/5 E |
| 3,415,083 | 12/1968 | Okazaki et al. | 68/5 E |
| 3,808,845 | 5/1974 | Lopata | 68/5 E |

FOREIGN PATENT DOCUMENTS

| | | | |
|---|---|---|---|
| 823,022 | 11/1959 | United Kingdom | 68/5 E |
| 326,989 | 4/1972 | U.S.S.R. | 68/5 E |

*Primary Examiner*—Philip R. Coe
*Attorney, Agent, or Firm*—Walter Becker

[57] ABSTRACT

A sealing arrangement for use at the inlet and outlet of containers in which a pressure above or below atmospheric pressure prevails, especially for treating webs of textile material. The sealing arrangement comprises two endless belts respectively looped around two pairs of reversing rollers with the rollers of each pair spaced from each other so that straight belt sections are formed between the rollers of each pair of reversing rollers. The web of goods is passed between two adjacent straight belt sections, which respectively pertain to the two endless belts, and rim portions, and which seal the space surrounded by the belts and located between the rollers against the pressure surrounding the container. The two reversing rollers of each belt which are respectively remote from the inlet and outlet of the container and/or the reversing rollers respectively adjacent the outlet of the container are adjustable relative toward and away from each other while the lateral rim portions of the belts sealingly engage the lateral container walls or walls parallel thereto.

10 Claims, 13 Drawing Figures

Fig. 3
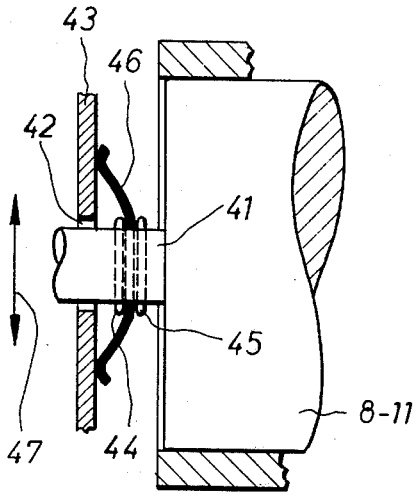
Fig. 4
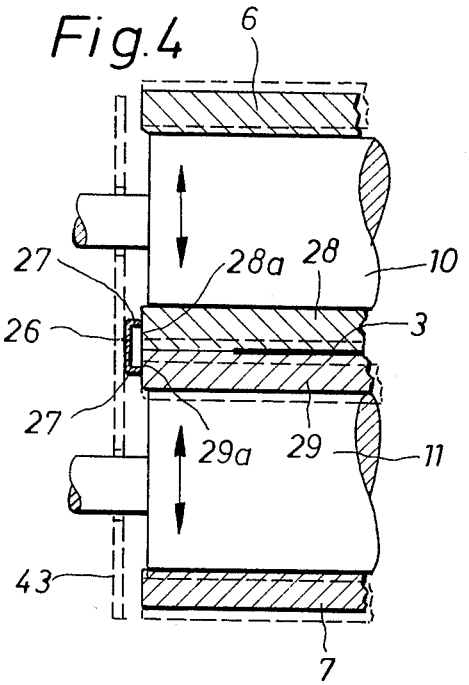
Fig. 5
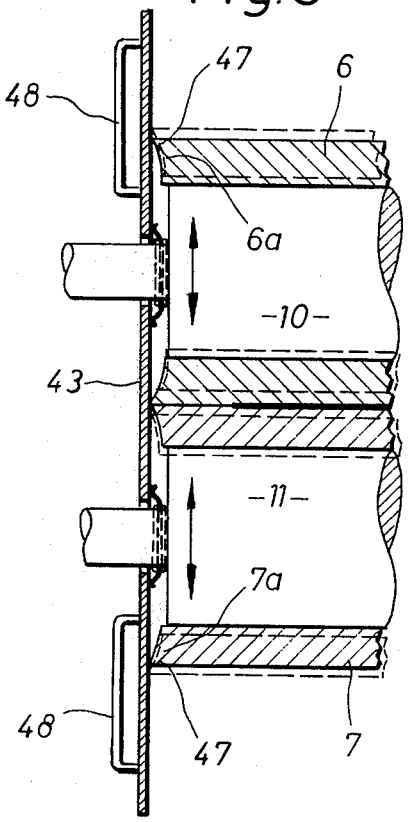
Fig. 6a
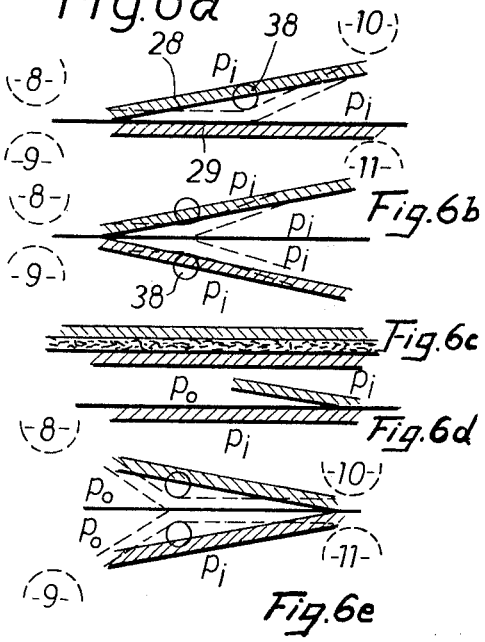
Fig. 6b
Fig. 6c
Fig. 6d
Fig. 6e

SEALING ARRANGEMENT FOR PRESSURE CONTAINERS, ESPECIALLY FOR THE TREATMENT OF WEBS OF TEXTILE GOODS

The present invention relates to a sealing system or sealer for goods at the inlet and outlet openings of containers in which a pressure below or above atmospheric pressure prevails, especially for the treatment of webs of textile goods, with two endless belts which pass over reversing rollers and between which there is provided a straight belt section over which the web of goods is passed, the rim portion of said two endless belts sealing the space enclosed by said belt and located between the rollers, against the pressure surrounding the container.

U.S. Pat. No. 3,352,129 discloses a sealer of the above mentioned general type, in which a pressure fluid is introduced into the space sealed with regard to the outer atmosphere and located between the rollers, which pressure fluid acts upon the inner side of said belts and the pressure of which pressure fluid is variable. There has also become known a sealer in which each individual belt has a straight belt section in sealing engagement with those walls of the container which respectively have an inlet and outlet opening, and in which the belts are arranged in the interior of the container and the inner belt sides are subjected to the pressure prevailing in the container.

It is an object of the present invention to provide a sealer or sealing system of the above general type by means of which a better adaptation of the sealing medium to the material of the web of goods to be treated is obtained, for instance, a better adaptation to the thickness, the dye or reaction substance and the pressure absorbability of the web of goods and by means of which also a greater pressure and thereby sealing range, in other words, an increased sealing effect, can be realized. In this connection, when increasing the pressure in the space between the rollers of a belt, necessarily always the increased belt tension inherent thereto has to be taken into consideration which not only absorbs a portion of the pressure exerted upon the belt inner side but also prevents a precise pressure release upon the web of goods and thus a precisely determinable sealing effect.

The above outlined objects and advantages of the invention will appear more clearly from the following specification in connection with the accompanying drawings, in which:

FIG. 1 is a side view of an embodiment of a sealer in an over pressure container according to the present invention.

FIG. 1*a* is a view of a sealer before an underpressure container.

FIG. 2 represents a section taken along the line II—II of FIG. 1.

FIG. 2*a* is a view taken in the direction of arrow 2*a* in FIG. 1.

FIG. 3 shows the sealing of a journal or roller end with regard to the container wall while the bearings for the roller have been omitted.

FIG. 4 illustrates on a scale larger than that of FIG. 1 a vertical section through the horizontal portion of a shield or plate.

FIG. 5 illustrates an embodiment in which the lateral edges of the belt are designed as sealing means with regard to the container wall.

FIGS. 6*a* to 6*e* illustrate the variation possibilities with regard to exerting pressure upon the belts.

Figure 7:
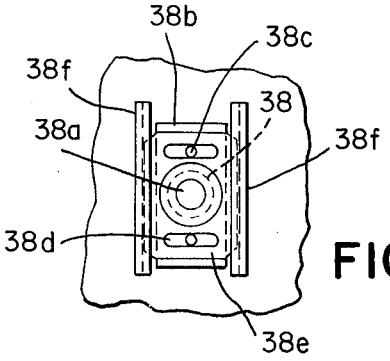

FIG. 7 shows journalling of intermediate rollers.

For purposes of realizing the above outlined objects, the invention provides a sealer of the above outlined general type in which the two reversing rollers facing away from the inlet and outlet opening respectively, and/or the two reversing rollers adjacent to the opening are adjustable relative to each other and away from each other while the lateral marginal zones of the belts sealingly engage the side walls of the container or displaceably engage parts parallel thereto.

Each of the rollers which advantageously are arranged in the interior of the container may be adjustable individually. The thickness of the endless compressible belts of the roller bodies preferably amounts to more than 10 millimeters. In order to be able to vary the pressure against the two belt sections which are arranged adjacent to each other, still further, it is possible between the rollers of a belt to arrange one or more auxiliary rollers which engage the belt inner side of those belt sections of the two endless belts which are located opposite to each other. These auxiliary rollers may be adjustable in the longitudinal direction of the belts and can be pressed against the belt inner side at variable pressure.

According to a preferred embodiment of the sealer according to the invention, the rollers which face away from the outlet or inlet opening may be pivotable about the axis of the roller adjacent to the opening.

The sealers which seal the belt sides and the belt surfaces preferably comprise plates or shields and rollers or roller seals for the belt surface, which rollers or roller seals are arranged between said plates or shields. Said plates or shields may preferably extend up to the height of the axis of the rollers which point away from the opening, in other words, may extend up to the level of the closing rollers. Instead of the shields or plates, the lateral edges or areas of the belts themselves may be designed as seals and may sealingly engage the lateral container walls in such a way that the belts are displaceable along said walls.

Referring now to the drawings in detail, the overpressure container 1 has an inlet opening 2 through which the web of goods 3 is passed in the direction of the arrow 4 into the container 1. In the advancing direction of the web of goods 3 behind the opening 2, there is provided the sealer according to the invention which is generally designated with the reference numeral 5. This sealer is arranged in the interior of the pressure container 1 and primarily comprises two endless belts 6, 7 and the rollers 8, 9 facing the inlet opening 2, and also comprises the two rollers 10, 11 which face away from the opening 2. The belts 6, 7 are compressible and have a thickness of preferably 20 millimeters. The belts themselves are of suitable material, for instance, rubber or a rubber-like synthetic material and are flexible in such a way that they can be looped as endless belts around the rollers 8, 10 and 9, 11.

The two rollers 8, 9 are adjustable in vertical direction from the position shown in solid lines and movable into the position indicated by dash lines, and vice versa. The rollers 10, 11 are movable about the axes 14, 15 of the two rollers 8, 9 in the direction of the arrows 16, 17 toward and away from each other.

Figure 1:
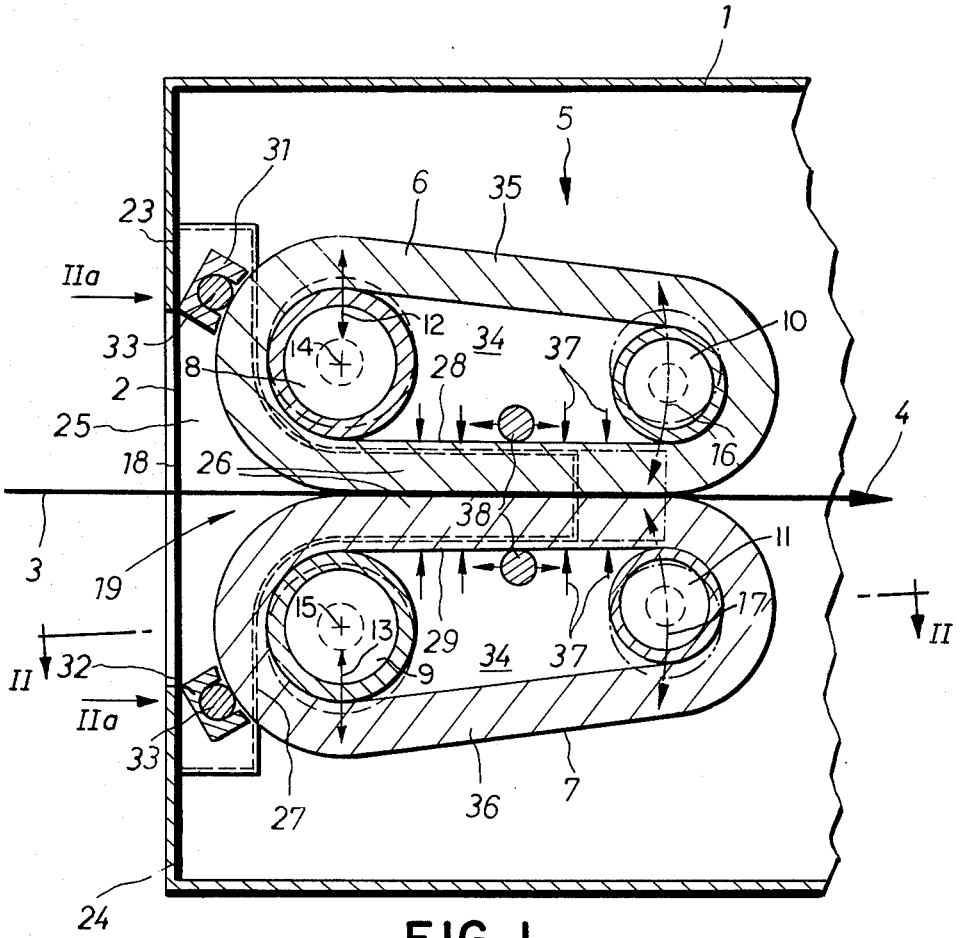
Figure 2A:
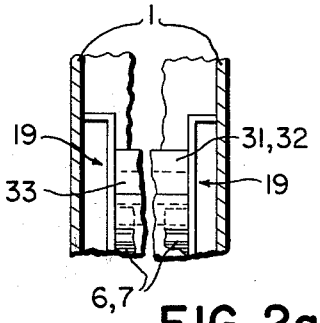

Starting from the wall sections 18 at the end face, which wall sections are located at both sides of the opening 2 of the pressure container 1, T-shaped plates or shields 19, 20 extend into the interior of the pressure container 1 at both sides of belts 6, 7. In FIG. 1 each shield has the form of a lying T. Adjacent to the vertically extending section 25 of each sealing shield 19, 20, is a horizontal section 26 which forms the shank of the T-shaped shield. The two sections 25, 26 of both shields engage the sides of the belts 6, 7 at the level of the rollers 8, 9 and of the adjacent belt sections 28, 29 of the belts 6, 7. The shields may also be provided with an elastic sealing strip which is arranged between the shields and the belt sides. The thickness of the belts may depend on said sealing elements.

The sections 26 of the two shields 19, 20 extend at least up to the level of the axes 14, 15 of the two rollers 8, 9 as is illustrated for instance in solid lines in FIG. 1 and extend up to short of the rollers 16, 17. Preferably, the sections 26 of the shields extend up to the level of the axes of said rollers 16, 17.

Between the ends of the sections 25 of the two shields 19, 20 there extends one profiled strip 31, 32 each of which receives a roller sealer or the like 33 in such a way that the rollers are adjustable in the direction of the arrows 12, 13 but always seal the inlet opening 2 relative to the interior of the pressure container 1. To this end, the distance of the profiled strip 31, 32 from the belts 6, 7 is selected sufficiently great, and the roller seal 33 itself is compressible in such a way that the rollers will be able to move over the desired path and distance in the direction of the arrows 12, 13 without thereby affecting the sealing effect of the seals 33.

The sealing device according to the present invention works in such a way that the two rollers 10, 11 are effective as sealing rollers so that when adjusting the two rollers relative to each other, the interior of the container 1 is sealed at low pressure relative to the surrounding of container 1. Since, however, the pressure in the interior of the container 1 prevails also within the region 34 between the belt sections 28, 35 on one hand and 29, 36 on the other hand, the inner pressure in container 1 can become effective in the direction of the short arrows 37 whereby the pressure differential between the pressure in the container 1 and the outer atmosphere can be exploited or made use of in a manner known per se. To this end, no additional pressure chambers with inlets and outlets and valves between the sections 28, 35 and 29, 36 of the two belts 6, 7 are necessary. The two closing rollers 10, 11 act automatically as a valve while simultaneously the pressure is determined at which the endless belts are pressed at the level of said rollers 10, 11. By means of the further rollers 8, 9 facing toward the inlet opening 2, it is possible by adjusting said rollers to vary the pressure at which the belts 6, 7 are pressed against the web 3 of the textile goods whereby the surface pressure of the belt sections 28, 29 against the web 3 can be varied. For purposes of varying said last mentioned pressure, additional auxiliary rollers 38 may be arranged between the rollers 8, 10 on one hand and 9, 11 on the other hand, which rollers are adjustable relative to each other and also in the direction of the indicated double arrows, which means along the belt sections 28, 29.

Figure 2:
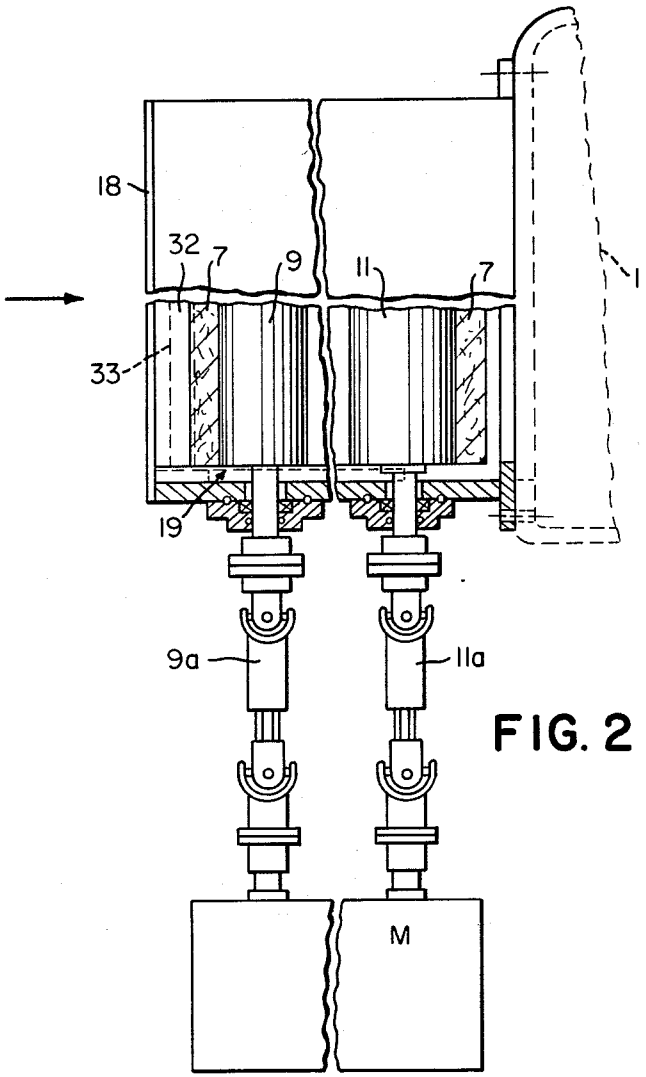

FIG. 2 shows the connection of rollers 9, 11 with the drive motor thereof. Pivot shafts 9*a,* 11*a* serve therefore. The rollers 6, 8 are driven by way of identical pivot shafts.

FIG. 3 shows on a larger scale than FIGS. 1 and 2 one end of one of the rollers 8–11 with their roller journal or roller end 41, which roller end is journalled in a conventional non-illustrated manner and extends through a corresponding slot 42 of the wall 43. Held on journal 41 by means of discs 44, 45 is a dish seal 46 which seals the slot 42 also when the journal 41 is with the rollers 8–10 moved in the direction of the double arrow 47.

FIG. 4 shows the sealing of section 26 of shield 19 with regard to the lateral edges 28*a,* 29*a* of the two respectively adjacent belt sections 28, 29 of the belts 6, 7 between which the web 3 of goods passes. The shield may by means of section 26 be held on wall 43 of the container 1.

Instead of the seal of the lateral edges 28*a,* 29*a* of belts 6, 7, which according to FIG. 4 are compressible so that the belt regions adjacent the web 3, which belt regions are adjacent to the shield section 26, engage each other, the lateral edges 6*a,* 7*a* of the belts 6, 7 (FIG. 5) may also themselves be designed as endless seals and may form a sealing tongue 47' which slides along the inner side of wall 43. In this connection, the inner pressure of the container is through conduits 48 conveyed into the space between the rollers 8, 10 and 9, 11 which space is surrounded by the belts 6, 7. The roller seals 33 extend likewise from side wall to side wall.

FIGS. 4 and 5 show in dash lines the position of the belts 6, 7 when the rollers 8, 10 and 9, 11 are moved away from each other.

FIGS. 6*a*–6*e* show examples of the position of belts 6, 7 with their sections 28, 29 relative to each other while the angle position of the belts is greatly increased or cambered. In the showing of FIG. 6*a,* only the roller 10 is adjusted. Due to the upper auxiliary roller 38, the belt section 28 occupies the position shown in dash lines. The inner pressure in this figure as well as in the other FIGS. 6*b* to 6*e* is designated with the character P*i.* According to the illustration of FIG. 6*b,* the rollers 10, 11 have moved away from each other so that a wedge-shaped gap (solid lines) is obtained. When the two auxiliary rollers 38 are adjusted relative to the rollers 8, 9, the position of the belt sections 28, 29 is obtained as is shown by dash lines. Also in this instance, the same pressure, namely the container pressure P*i,* prevails on both sides of the sections 28, 29.

The position shown in FIG. 6*c* results in a unilateral pressure against the parallel belt sections, whereas according to FIGS. 6*d* and 6*e* in the wedge-shaped gap a surrounding pressure P*o* prevails while the container pressure P*i* acts upon that side which faces away from the gap. Also in this instance it is possible by means of the auxiliary rollers 38 and the adjustment thereof to realize additionally a section-wise movement toward each other of the belt sections 28, 29.

FIG. 7 shows the journalling of rollers 38 with roller pins 38*a* thereof in a bearing plate 38*b* which carries two pins 38*c* that project through slots 38*d* of a guide plate 38*e* guided along guides 38*f* that extend at right angles to the slots 38*d.* The roller 38 accordingly can be moved in two directions at right angles to each other.

Figure 1A:
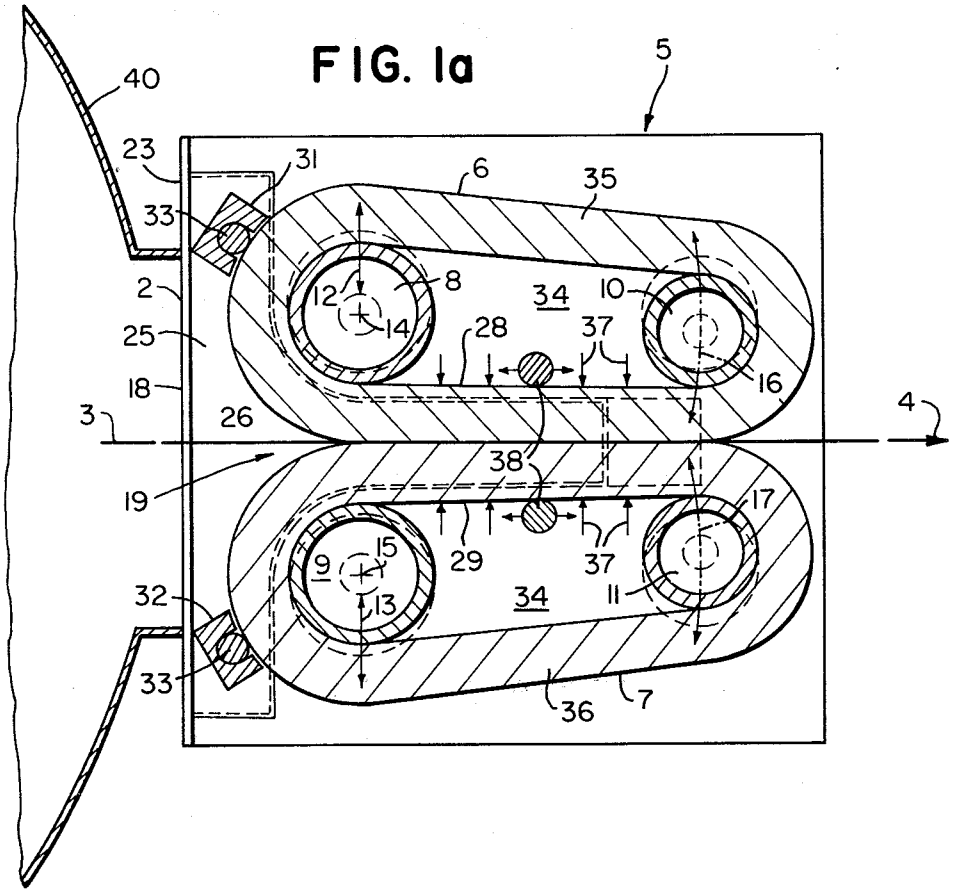

Instead of the arrangement illustrated in FIG. 1 of the sealer in a container in which a pressure above atmospheric pressure prevails, the sealer or sealing system according to the invention may also be employed at the outlet or inlet opening of the vacuum container as shown in the vacuum container 40 indicated in dash lines in FIG. 1, and more particularly in FIG. 1*a.* The sealer according to the invention will then be located in the atmosphere surrounding the vacuum container and thus again within the region of the higher pressure. Instead of providing the sealer according to the invention in a horizontal direction as shown in the drawings, it may, of course, also be employed in vertical or inclined position.

It is of course, to be understood that the present invention is, by no means, limited to the specific showing in the drawings but also comprises any modifications within the scope of the appended claims.

It is also to be understood that while the drawings show only a sealing arrangement according to the invention at the inlet to the container, the sealing arrangement employed with the outlet from the container is structurally the same as that illustrated in the drawings for the inlet of the container but is arranged as an image of the showing in FIG. 1.

What I claim is:

1. In combination with a container for treating webs of textile goods at above and below atmospheric pressure which is provided with an inlet opening and an outlet opening for respectively passing such webs through said inlet and outlet openings into and out of said container in a gas-tight manner, a pair of sealers including a first sealer and a second sealer respectively arranged at said inlet and outlet openings, each of said sealers comprising: a first pair of rollers each having an axis of rotation and arranged in spaced relationship to each other with the axes of rotation of said rollers substantially parallel to each other, a first endless belt looped around said first pair of rollers so as to define between said rollers a first and second straight belt section, a second pair of rollers each having an axis of rotation and arranged in spaced relationship to each other with the axes of rotation of the rollers of said second pair of rollers substantially parallel to each other, a second endless belt looped around said second pair of rollers so as to define between the rollers of said second pair of rollers a third and a fourth straight belt section, each of said first and second endless belts of each sealer having one of their straight belt sections define with each other a sealing passage for the web of textile goods to be passed therethrough on its way into and out of said container, driving means operatively connected with at least one roller of said first pair and second pair of rollers of said first and second sealer to establish synchronous movement of the belt sections which define the sealing passage of said first and second sealer respectively, at least one roller of each of said first pair of rollers being adjustable relatively toward and away from the rollers of said second pair of rollers, said first and second belts of each sealer sealingly engaging said container, said first and second pairs of rollers defining therebetween a space in which pressure remains effective.

2. In combination with a container for treating webs of textile goods at above and below atmospheric pressure which is provided with an inlet opening and an outlet opening for respectively passing such webs through said inlet and outlet openings into and out of said container in a gas-tight manner, a pair of sealers including a first sealer and a second sealer respectively arranged at said inlet and outlet openings, each of said sealers comprising: a first pair of rollers each having an axis of rotation and arranged in spaced relationship to each other with the axes of rotation of said rollers substantially parallel to each other, a first endless belt looped around said first pair of rollers so as to define between sad rollers a first and a second straight belt section, a second pair of rollers each having an axis of rotation and arranged in spaced relationship to each other with the axes of rotation of the rollers of said second pair of rollers substantially parallel to each other, a second endless belt looped around said second pair of rollers so as to define between the rollers of said second pair of rollers a third and a fourth straight belt section, each of said first and second endless belts of each sealer having one of their straight belt sections define with each other a sealing passage for the web of textile goods to be passed therethrough on its way into and out of said container, driving means operatively connected with at least one roller of said first pair and second pair of rollers of said first and second sealer to establish synchronous movement of the belt sections which define the sealing passage of said first and second sealer respectively, at least one roller of each of said first pair of rollers being adjustable relatively toward and away from the rollers of said second pair of rollers, said first and second belts of each sealer sealingly engaging said container, each of the rollers of each of said sealers being adjustable individually.

3. An arrangement in combination according to claim 2, in which the thickness of each of said first and second endless belts of each of said sealers is in excess of 10mm.

4. An arrangement in combination according to claim 2, in which between the rollers of each of said first and second pairs of rollers there are provided auxiliary rollers for engaging under pressure those straight belt sections which with each other form said sealing passage.

5. In combination with a container for treating webs of textile goods at above and below atmospheric pressure which is provided with an inlet opening and an outlet opening for respectively passing such webs through said inlet and outlet openings into and out of said container in a gas-tight manner, a pair of sealers including a first sealer and a second sealer respectively arranged at said inlet and outlet openings, each of said sealers comprising: a first pair of rollers each having an axis of rotation and arranged in spaced relationship to each other with the axes of rotation of said rollers substantially parallel to each other, a first endless belt looped around said first pair of rollers so as to define between said rollers a first and a second straight belt section, a second pair of rollers each having an axis of rotation and arranged in spaced relationship to each other with the axes of rotation of the rollers of said second pair of rollers substantially parallel to each other, a second endless belt looped around said second pair of rollers so as to define between the rollers of said second pair of rollers a third and a fourth straight belt section, each of said first and second endless belts of each sealer having one of their straight belt sections define with each other a sealing passage for the web of textile goods to be passed therethrough on its way into and out of said container, driving means operatively connectd with at least one roller of said first pair and a second pair of rollers of said first and second sealer to establish synchronous movement of the belt sections which define the sealing passage of said first and second sealer respectively, at least one roller of each of said first pair of rollers being adjustable relatively toward and away from the rollers of said second pair of rollers, said first and second belts of each sealer sealingly engaging said container, between the rollers of each of said first and second pairs of rollers there being provided an auxiliary roller for engaging under pressure those straight belt sections which with each other form said sealing passage, said auxiliary roller being adjustable longitudinally of said straight belt sections defining said sealing passage for the web of textile goods to be treated in said container.

6. In combination with a container for treating webs of textile goods at above and below atmospheric pressure which is provided with an inlet opening and an outlet opening for respectively passing such webs through said inlet and outlet openings into and out of said container in a gas-tight manner, a pair of sealers including a first sealer and a second sealer respectively arranged at said inlet and outlet openings, each of said sealers comprising: a first pair of rollers each having an axis of rotation and arranged in spaced relationship to each other with the axes of rotation of said rollers substantially parallel to each other, a first endless belt looped around said first pair of rollers so as to define between said rollers a first and second straight belt section, a second pair of rollers each having an axis of rotation and arranged in spaced relationship to each other with the axes of rotation of the rollers of said second pair of rollers substantially parallel to each other, a second endless belt looped around said second pair of rollers so as to define between the rollers of said second pair of rollers a third and a fourth straight belt section, each of said first and second endless belts of each sealer having one of their straight belt sections define with each other a sealing passage for the web of textile goods to be passed therethrough on its way into and out of said container, driving means operatively connected with at least one roller of said first pair and second pair of rollers of said first and second sealer to establish synchronous movement of the belt sections which define the sealing passage of said first and second sealer respectively, at least one roller of each of said first pair of rollers being adjustable relatively toward and away from the rollers of said second pair of rollers, said first and second belts of each sealer sealingly engaging said container, one of the rollers of said first pair of rollers being pivotable about the axis of rotation of the other one of said rollers of said first pair of rollers, and one of said rollers of said second pair of rollers being pivotable about the axis of rotation of the other one of the rollers of said second pair of rollers.

7. In combination with a container for treating webs of textile goods at above and below atmospheric pressure which is provided with an inlet opening and an outlet opening for respectively passing such webs through said inlet and outlet openings into and out of said container in a gas-tight manner, a pair of sealers including a first sealer and a second sealer respectively arranged at said inlet and outlet openings, each of said sealers comprising: a first pair of rollers each having an axis of rotation and arranged in spaced relationship to each other with the axes of rotation of said rollers substantially parallel to each other, a first endless belt looped around said first pair of rollers so as to define between said rollers a first and a second straight belt section, a second pair of rollers each having an axis of rotation and arranged in spaced relationship to each other with the axes of rotation of the rollers of said second pair of rollers substantially parallel to each other, a second endless belt looped around said second pair of rollers so as to define between the rollers of said second pair of rollers a third and a fourth straight belt section, each of said first and second endless belts of each sealer having one of their straight belt section define with each other a sealing passage for the web of textile goods to be passed therethrough on its way into and out of said container, driving means operatively connected with at least one roller of said first pair and second pair of rollers of said first and second sealer to establish synchronous movement of the belt sections which define the sealing passage of said first and second sealer respectively, at least one roller of each of said first pair of rollers being adjustable relatively toward and away from the rollers of said second pair of rollers, said first and second belts of each sealer sealingly engaging said container, sealing shields for each sealer arranged in sealing arrangement with said first and second endless belts, and roller seals held between said shields.

8. An arrangement in combination according to claim 7, in which the respective sealing shields of each sealer extend from said container to approximately a plane passing through the axes of rotation of those rollers of the same sealer remote therefrom.

9. An arrangement in combination according to claim 2, in which said belts are provided with sealing means sealingly engaging said container and relatively slidable thereon.

10. An arrangement in combination according to claim 2, in which said endless belts are compressible.

* * * * *